United States Patent [19]

Schur

[11] Patent Number: 4,740,324

[45] Date of Patent: Apr. 26, 1988

[54] TENACIOUS OIL COMPOSITION AND ITS USE AS A LUBRICANT OR MOLD RELEASE AGENT

[75] Inventor: Hans Schur, Bad Urach, Fed. Rep. of Germany

[73] Assignee: Erich Sollner, Fed. Rep. of Germany

[21] Appl. No.: 76,669

[22] Filed: Jul. 23, 1987

[30] Foreign Application Priority Data

Aug. 4, 1986 [DE] Fed. Rep. of Germany ..... 3626376

[51] Int. Cl.[4] ..... C10M 105/32

[52] U.S. Cl. ..... 252/56 R; 252/11; 264/130; 264/338; 106/38.24

[58] Field of Search ..... 252/56 R, 56 S, 11; 106/38.22, 38.24; 264/130, 338

[56] References Cited

U.S. PATENT DOCUMENTS

| | | | |
|---|---|---|---|
| 1,612,391 | 12/1926 | Minnear | 106/38.24 |
| 1,944,164 | 1/1934 | Bijur | 252/56 R |
| 2,114,525 | 4/1938 | Eichwald | 252/56 R |
| 2,840,479 | 6/1958 | Rowell et al. | 106/38.24 |
| 4,634,469 | 1/1987 | Laemmle et al. | 106/38.24 |

*Primary Examiner*—Jacqueline V. Howard

*Attorney, Agent, or Firm*—Darby & Darby

[57] ABSTRACT

Disclosed are biodegradable tenacious compositions comprising a biodegradable lubricating oil and a biodegradable resinous component selected from the group consisting of colophonium-containing resins, colophonium and mixtures thereof. Also disclosed are methods for using such compositions and articles coated therewith.

15 Claims, No Drawings

TENACIOUS OIL COMPOSITION AND ITS USE AS A LUBRICANT OR MOLD RELEASE AGENT

FIELD OF THE INVENTION

The invention relates to biodegradable, tenacious, oil-containing compositions, comprising a lubricating oil component and a resinous component (which ensures that the composition will cling to the substrate) and to the use of such compositions as lubricants or as mold release agents.

BACKGROUND OF THE INVENTION

Oil-containing compositions used as lubricants for motor saw chains are consumed in great quantities in the Federal Republic of Germany and elsewhere. In West Germany, the annual consumption of such motor saw chain lubricant compositions amounts to about 6–7 million liters. In addition, the construction industry, requires considerable amounts of adhesive oil compositions as release agents for construction casings, particularly concrete construction cases in which the casing panels must be readily releasable from the concrete construction after hardening of the concrete poured into the casing. Such mold release agents are coated on the surface of the casing panels facing the concrete mixture to permit ready release of such panels. It is evident that such compositions must be tenacious, i.e., must cling or stick to the substrate to which they are applied.

Existing tenacious oil-containing compositions of both types employ an adhesive component (i.e. a component causing the composition to cling to the substrate comprising a high molecular weight polymer such as a polyethylene glycol or polyacrylic amide, each having a molecular weight of 1 million or above. Although these polymers impart sufficient tenacious property (or stickiness) to the composition, they are not biodegradable.

Known tenacious oil-containing compositions also contain (often toxic or mutagenic) mineral oils, i.e. petroleum distillation products or synthetic oils, such as hydrocarbon oils (polyolefins, halogenated hydrocarbons, etc.) and non-hydrocarbon oils (such as ester oils), none of which are biodegradable. As a result, known tenacious oil-containing compositions remain in the environment after use for a great period of time causing considerable pollution particularly of the waterbed. As is generally known, one liter of such compositions is sufficient to render about 1 million liters of water unfit for human consumption.

Certain colophonium containing compositions are known in the art, but not as mold release agents nor as lubricants. For example, mineral oil solutions of colophonium have been used in newspaper printing inks and as additives in mineral and synthetic oils (Ullmanns Encyclopedia of Technical Chemistry, 4th Ed. vol. 12, p. 530) as well as in paste-like petrolatum solder fluxes. Also known are dehairing compositions for pigskin consisting of 88–93% colophonium fused with 7–12% cotton seed oil (Kirk-Othmer, Encyclopedia of Chemical Technology, 2nd ed., vol. 17, pp. 481–82).

SUMMARY OF THE INVENTION

It is therefore an object of the present invention to provide tenacious oil-containing compositions which are completely biodegradable in a relatively short period of time (e.g., a few months to a few years).

It is also an object of the present invention to provide biodegradable tenacious oil-containing compositions that exhibit at least comparable performance to existing non-biodegradable oil-containing compositions.

It is another object of the invention to provide a method for lubricating articles, such as motor saw chains with such compositions. Another object is to provide releasable casings or molds and a method for making them.

These and other objects of the present invention are attained by a tenacious oil-containing composition comprising a biodegradable lubricating oil component and a biodegradable resinous component selected from the group consisting of colophonium-containing resins, colophonium, and mixtures thereof, wherein the weight ratio of lubricating oil to the resinous component being (a) about 40–80 parts of oil to about 60–20 parts of resinous component, or (b) about 70–90 parts of said oil to about 30–10 parts of said resinous component.

DETAILED DESCRIPTION OF THE INVENTION

The tenacious oil compositions of the present invention are completely biodegradable since both the lubricating oil component and the resinous component are completely biodegradable. Therefore, the compositions of the present invention do not pollute the environment.

Use of at least one colophonium-containing resin and/or colophonium in a lubricating tenacious oil composition results in a composition having excellent tenacious (clinging or sticking to the substrate) properties when used as a lubricant (e.g., for motor saw chains) or as a mold release agent (e.g., for construction casings).

Examples of the biodegradable colophonium-containing resins suitable for use in the present invention are:

- balsam resin obtained from turpentine balsam (such as pine exudate);
- root resin obtained by solvent extraction from root stocks; and
- tall resin obtained by fractional distillation of tall oil, which is a by-product of the digestion of wood pulp (e.g. for cellulose production).

In addition, the resinous component to be employed in the tenacious oil-containing composition of the present invention may be colophonium itself. Colophonium is obtained from balsam resin, root resin or tall resin by well-known methods. Tall resin is preferred because it imparts particularly desirable tenacious properties to the compositions of the present invention.

Preferred lubricating oil components are vegetable oils, animal oils and mixtures thereof.

Preferred lubricant oils include rape seed oil, sunflower oil, castor oil, olive oil, peanut oil, soya oil, or whale oil. Rape seed oil and/or, sunflower oil, and/or castor oil are particularly preferred. The addition of castor oil to rape seed oil and/or sunflower oil is advantageous because of the excellent lubricating properties of castor oil.

The compositions of the present invention have excellent stability so that a stabilizing agent need not be used. However, if desired, about 1–5 wt. % of a stabilizer (e.g. sorbitol) may be added.

When the compositions of the present invention are to be used, e.g., as motor saw chain lubricants, the weight ratio of lubricating oil to the resinous component may be within the range of about 40–80 parts lubricating oil per about 60–20 parts resinous component. Preferably, such ratio is 50–60 parts lubricating oil and 50–40 parts resinous component. Particularly preferred is a 50—50 mixture of lubricating oil to resinous component.

When employed as motor saw chain lubricants, the compositions of the present invention do not require additives such as corrosion inhibitors or additives imparting wear-resistance. The composition of the present invention has excellent anticorrosion and wear resistance properties.

When employed as a mold release agent the composition of the present invention preferably contains from about 90 to about 70 weight parts of lubricating oil for about 10 to about 30 weight parts of resinous component. Preferably a mixture of 80 weight parts lubricating oil to 20 weight parts of resinous component is used.

The composition of the present invention is particularly suitable as a lubricant (e.g., for motor chain saws) and as a mold release agent (e.g., to ensure the releasability of construction casings, such as concrete construction casings). It is suitable for the so-called absorbent casings (e.g., wood) as well as for non-absorbent casings (e.g., light metals or steel).

The adhesive oil compositions of the present invention may be made simply by mixing the oil (or combination of oils) component with the resinous component (or combination thereof). Such mixing may take place in a mixer wherein the oil component is added first followed by addition of the resinous component. The mixing operation can be carried out at room temperature. The mixing (agitation) time depends of course on the capacity of the mixing means and on the volume of the quantities to be mixed. For example, a mixer having a capacity of 1,000 liters holding about 900 liters of the combination of oil and resinous components will yield a homogeneous composition at usual mixing speeds (from about 1000 to about 1800 rpm) in about 10 minutes. Such homogeneous compositions will not undergo phase separation even after extended storage. In the case of a composition containing 50 parts of sunflower oil and 50 parts of tall resin or one containing 60 parts of rape seed oil and 40 parts of tall resin, no separation was observed after storage for 18 months.

The following examples serve to further illustrate the present invention in terms of particularly preferred embodiments without limiting its scope.

EXAMPLE 1

Lubricant Composition (A) For summer use: 50 parts sunflower oil, 50 parts tall resin;

(B) For summer use: 60 parts sunflower oil, 40 parts colophonium;

(C) For winter use: 60 parts rape seed oil, 40 parts tall resin.

The viscosity of the adhesive oil (C) is about 0.012 Pascal. seconds (12 centipoise) at 10° C. and about 0.008 Pascal. seconds (8 centipoise) at 15° C.

(D) For winter use: 40 weight arts rape seed oil, 15 weight parts castor oil, and 45 weight parts tall resin—80 weight parts sunflower oil and 20 weight parts tall resin.

EXAMPLE 2

Lubricating a Motor Chain Saw

A motor chain saw (Model Aseco No. 28—Made by Stihl, West Germany) is treated as follows:

Three hundred $cm^3$ of composition (A) of Example 1 are provided in a container. The motor chain saw is started and the composition is metered on the chain. The thus treated motor chain saw can be used for about half an hour under full load.

EXAMPLE 3

Mold Provided with Mold Release Agent

A concrete construction casing made of steel is provided. A coating of the composition of the present invention containing 20 parts by weight of tall resin and 80 parts by weight rape seed oil is coated substantially uniformly on the surface of the casing that would face the concrete mass. The casing is then used as a mold for a concrete slab.

After three days, the concrete had hardened. The casing is disassembled and removed from the concrete slab. Release is ready and effortless.

Generally, about 100 $cm^3$ of mold release agent should be used per square meter of mold substrate.

Suitable substrates (molds) include for example wood, light metals and steel.

What is claimed is:

1. A biodegradable tenacious oil-containing composition comprising a mixture of a biodegradable lubricant oil and a resinous component said component being selected from the group consisting of colophonium-containing biodegradable resins, colophonium and mixtures thereof, the weight ratio of said oil to said resinous component being within a range selected from the group consisting of:

(a) about 40 to about 80 weight parts of said oil per about 60 to about 20 weight parts of said resinous component; and (b) about 70 to about 90 weight parts of said oil per about 30 to about 10 weight parts of said resinous component.

2. The composition of claim 1 wherein said oil is selected from the group consisting of vegetable oils, animal oils and mixtures thereof.

3. The composition of claim 1 wherein said resinous component is tall resin.

4. The composition of claim 1 wherein said oil is vegetable oil selected from the group consisting of rape seed oil, sunflower oil, castor oil, and mixtures thereof.

5. The composition of claim 2 further comprising from about one to about 5 weight percent of sorbitol.

6. The composition of claim 3 further comprising from about one to about 5 wt. % sorbitol.

7. The composition of claim 4 further comprising from about one to about 5 wt. % sorbitol.

8. The composition of claim 4 wherein said range is (a) said composition being useful as a lubricant.

9. The composition of claim 1 wherein said range is (b) said composition being useful as a mold release agent.

10. The composition of claim 8 wherein the ratio of said lubricant oil and said resinous component is 50/50.

11. The composition of claim 9 wherein the ratio of said lubricant oil to said resinous component is 80/20.

12. A method for lubricating a motor saw chain comprising applying to said chain a lubricating effective amount of a composition comprising a mixture of a biodegradable lubricant oil and a resinous component selected from the group consisting of biodegradable colophonium containing resins, colophonium and mixtures thereof, the weight ratio of said oil to said resinous component being within the range: about 40 to about 80 weight parts of said oil to about 60 to about 20 weight parts of said resinous component.

13. A method of rendering a mold releasable from a molded article cast therein comprising applying to a surface of said mold that will be in contact with said article, a substantially uniform coating of a release-effective amount of a mold release agent comprising a mixture of a biodegradable lubricant oil and a resinous component said component being selected from the group consisting of biodegradable colophonium-containing resins, colophonium, and mixtures thereof, the weight ratio of said oil to said resinous component being within the range of about 70 to about 90 weight parts of said oil per about 30 to about 10 weight parts of said resinous component.

14. A lubricated motor saw chain coated with a lubricating effective amount of a tenacious biodegradable composition comprising a biodegradable lubricant oil component and a resinous component selected from the group consisting of biodegradable colophonium-containing resins, colophonium and mixtures thereof wherein the weight ratio of said oil to said resinous component is within the range of about 40 to about 80 weight parts of said oil per about 80 to about 40 weight parts of said resinous component.

15. A releasable mold article comprising a mold coated on a surface contacting the article cast therein with a substantially uniform coating of a mold-release effective amount of a composition comprising a biodegradable oil component and a resinous component, said resinous component being selected from the group consisting of biodegradable colophonium-containing resins, colophonium and mixtures thereof, therein the weight ratio of said oil to said resinous component is within the range of about 70 to about 90 weight parts of said oil per about 30 to about 10 weight parts of said resinous component.

* * * * *